US011142890B2

(12) United States Patent
Peat et al.

(10) Patent No.: US 11,142,890 B2
(45) Date of Patent: Oct. 12, 2021

(54) SYSTEM AND METHOD OF SOIL MANAGEMENT FOR AN IMPLEMENT

(71) Applicant: DEERE & COMPANY, Moline, IL (US)

(72) Inventors: Michael D. Peat, Dubuque, IA (US); John M. Hageman, Dubuque, IA (US); Craig Christofferson, Dubuque, IA (US); Tarik Loukili, Johnston, IA (US)

(73) Assignee: DEERE & COMPANY, Moline, IL (US)

( * ) Notice: Subject to any disclaimer, the term of this patent is extended or adjusted under 35 U.S.C. 154(b) by 500 days.

(21) Appl. No.: 16/058,055

(22) Filed: Aug. 8, 2018

(65) Prior Publication Data

US 2020/0048870 A1 Feb. 13, 2020

(51) Int. Cl.
*E02F 9/26* (2006.01)
*E02F 3/84* (2006.01)
*E02F 3/76* (2006.01)

(52) U.S. Cl.
CPC ..... *E02F 9/262* (2013.01); *E02F 3/7677* (2013.01); *E02F 3/844* (2013.01); *E02F 9/264* (2013.01)

(58) Field of Classification Search
CPC ..... E02F 9/262; E02F 9/264; E02F 3/7677; E02F 3/844
See application file for complete search history.

(56) References Cited

U.S. PATENT DOCUMENTS

2015/0225923 A1 8/2015 Wallace et al.
2015/0240453 A1 8/2015 Jaliwala et al.
2016/0076222 A1* 3/2016 Taylor ..... E02F 9/205 701/50
2016/0299116 A1 10/2016 Talmaki et al.
2017/0226717 A1 8/2017 Cherney
2018/0061040 A1 3/2018 Beery et al.
2018/0174291 A1 6/2018 Asada et al.
2019/0055715 A1* 2/2019 Wei ..... E02F 3/841

FOREIGN PATENT DOCUMENTS

WO 2017163823 A1 9/2017
WO 2017164053 A1 9/2017

OTHER PUBLICATIONS

German Search Report issued in counterpart application No. 102019211801.1 dated May 14, 2020 (08 pages).

* cited by examiner

*Primary Examiner* — Jamie L McGowan
(74) *Attorney, Agent, or Firm* — Taft Stettinius & Hollister LLP; Stephen F. Rost

(57) ABSTRACT

A vehicle grade control system and method of controlling an implement position of a motor grader moving along a path of a surface. The motor grader includes a frame supported by a ground engaging traction device and an implement adjustably coupled to the frame. The control system includes a processor and a memory configured to receive a grade target to grade the surface to a desired grade with the implement, based on the grade target. A front image sensor provides images of a front surface profile, an implement image sensor provides images of collected surface material on the implement, and a rear image sensor provides images on a rear surface profile. The surface is graded by adjusting a position of the implement based on the images provided by each of the front image sensor, the implement image sensor, and the rear image sensor.

20 Claims, 4 Drawing Sheets

SYSTEM AND METHOD OF SOIL MANAGEMENT FOR AN IMPLEMENT

FIELD OF THE DISCLOSURE

The present disclosure relates to a work vehicle, such as a motor grader, for grading a surface, and in particular to a vehicle grade control system for controlling an implement position based on a forward looking sensor, a rearward looking sensor, and an implement image sensor to achieve a desired grade of the surface.

BACKGROUND

Work vehicles, such as a motor grader, can be used in construction and maintenance for grading terrain to a flat surface at various angles, slopes, and elevations. When paving a road for instance, a motor grader can be used to prepare a base foundation to create a wide flat surface to support a layer of asphalt. A motor grader can include two or more axles, with an engine and cab disposed above the axles at the rear end of the vehicle and another axle disposed at the front end of the vehicle. An implement, such as a blade, is attached to the vehicle between the front axle and rear axle.

Motor graders include a drawbar assembly attached toward the front of the grader, which is pulled by the grader as it moves forward. The drawbar assembly rotatably supports a circle drive member at a free end of the drawbar assembly and the circle drive member supports a work implement such as the blade, also known as a mold board. The angle of the work implement beneath the drawbar assembly can be adjusted by the rotation of the circle drive member relative to the drawbar assembly.

In addition, to the blade being rotated about a rotational fixed axis, the blade is also adjustable to a selected angle with respect to the circle drive member. This angle is known as blade slope. The elevation of the blade is also adjustable.

To properly grade a surface, the motor grader includes a one or more sensors which measure the orientation of the vehicle with respect to gravity and the location of the blade with respect to the vehicle. A rotation sensor located at the circle drive member provides a rotational angle of the blade with respect to a longitudinal axis defined by a length of the vehicle. A blade slope sensor provides a slope angle of the blade with respect to a lateral axis which is generally aligned with a vehicle lateral axis, such as defined by the vehicle axles. A mainfall sensor provides an angle of travel of the vehicle with respect to gravity.

Machine control systems, which include 2 dimensional (2D) and 3 dimensional (3D) machine control systems, are located at the surface being graded to provide grade information to the motor grader. A vehicle grade control system receives signals from the machine control system to enable the motor grader to grade the surface. The motor grader includes a grade control system operatively coupled to each of the sensors, so that the surface being graded can be graded to the desired slope, angle, and elevation. The desired grade of the surface is planned ahead of or during a grading operation.

Machine control systems can provide slope, angle, and elevation signals to the vehicle grade control system to enable the motor grader or an operator to adjust the slope, angle, and elevation of the blade. The vehicle grade control system can be configured to automatically control the slope, angle, and elevation of the blade to grade the surface based on desired slopes, angles, and elevations as is known by those skilled in the art. In these automatic systems, adjustments to the position of the blade with respect to the vehicle are made constantly to the blade in order to achieve the slope, angle and/or elevation targets. Many vehicle grade control systems offer an included or optional display that indicates to the operator how well the vehicle grade control system is keeping up to the target slope, angle, and/or elevation.

Each surface being graded includes surface irregularities and surface materials of different types. While current grade control systems are used to adjust the implement based on inputs received from the machine control system, such systems do not account for the type of surface material being graded. Because characteristics of surface materials vary widely, grading operations can be affected in different ways based on the types of surface materials. Therefore, a need exists for adjusting the position of a work implement based on the occurrence of the different types, characteristics, conditions, and properties of surface materials when grading a surface to a grade target.

SUMMARY

In one embodiment of the present disclosure, there is provided a method of a method of grading a surface with a work vehicle moving along the surface, the surface having a ground profile and formed of a surface material. The vehicle includes a frame supported by a ground engaging traction device and an implement adjustably coupled to the frame. The method includes: receiving a grade target identifying a desired grade for the surface being graded with the implement; collecting surface material on the implement; identifying a material property of the collected surface material; identifying a position of the implement with respect to the surface; adjusting the position of the implement based on the identified position and the identified material property; and grading the surface to the grade target with the adjusted position of the implement.

In another embodiment of the present disclosure, there is provided a grade control system for a vehicle having a frame and an implement coupled to the frame. The implement is configured to collect and move surface material for grading a surface having a current grade to a grade target. The control system includes an antenna operatively connected to one of the frame or the implement wherein the antenna is configured to receive a location of the vehicle with respect to the surface. An implement image sensor is mounted on the vehicle and oriented toward the implement to record images of surface material collected by the implement. Control circuitry is operatively connected to the antenna and to the implement image sensor. The control circuitry includes a processer and a memory, wherein the memory is configured to store program instructions. The processor is configured to execute the stored program instructions to: identify a material property of the collected surface material based on the recorded images of the collected surface material; identify a first position of the implement based on a current position of the implement with respect to the surface; identify a second position of the implement based on the identified material property; and move the implement from the first position to the second position to grade the surface.

In still another embodiment of the present disclosure, there is provided a method a method of grading a surface with a work vehicle moving along the surface, the surface having a ground profile and formed of a surface material. The vehicle includes a frame and an implement adjustably coupled to the frame. The method includes: identifying a front surface profile in front of the work vehicle; identifying a material property of a collected surface material located on the implement; identifying a rear surface profile at the rear of the work vehicle; adjusting a position of the implement based on the identified front surface profile, the identified material property, and the identified rear surface profile; and grading the surface to a grade target with the adjusted position of the implement.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
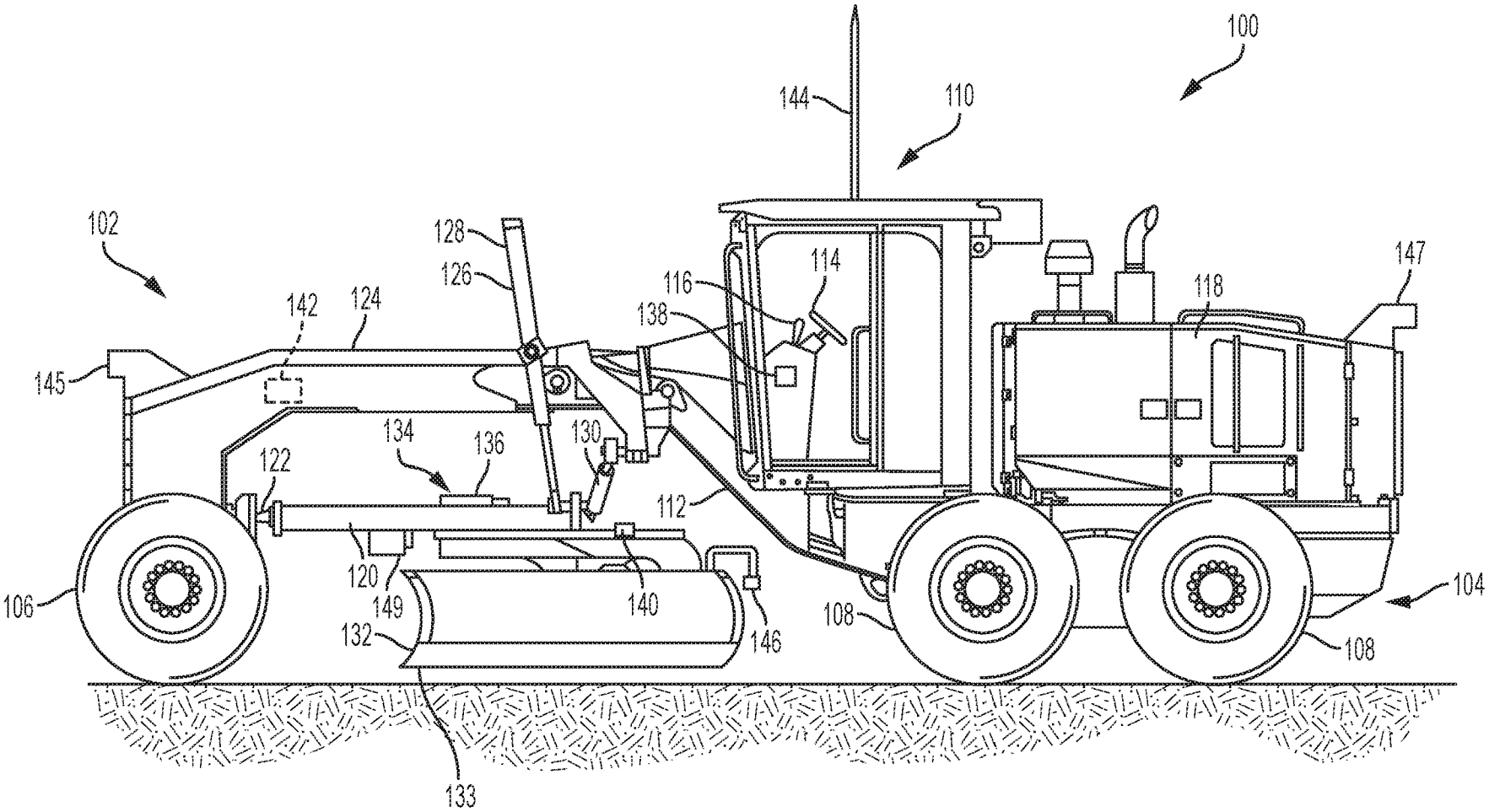
FIG. 1 is a side view of a motor grader.

Referring to FIG. 1, an exemplary embodiment of a vehicle, such as a motor grader 100, is shown. An example of a motor grader is the 772G Motor Grader manufactured and sold by Deere & Company. While the present disclosure discusses a motor grader, other types of work machines are contemplated including graders, road graders, dozers, bulldozers, and front loaders.

As shown in FIG. 1, the motor grader 100 includes front frame 102 and rear frame 104, with the front frame 102 being supported on a pair of front wheels 106, and with the rear frame 104 being supported on right and left tandem sets of rear wheels 108. A straight line extending between the wheel centers generally defines a wheel axis transverse to a longitudinal plane of the vehicle 100 and generally parallel to wheel treads in contact with the surface being graded. The frames can be rigid or articulated. Other ground engaging traction devices, such as treads, are contemplated.

An operator cab 110 is mounted on an upwardly and inclined rear region 112 of the front frame 102 and contains various controls for the motor grader 100 disposed so as to be within the reach of a seated or standing operator. In one aspect, these controls may include a steering wheel 114 and a lever assembly 116. A user interface 117 is supported by a console located in the cab and includes one or more different types of operator controls including manual and electronic buttons of switches. In different embodiments, the user interface 117 includes a visual display providing operator selectable menus for controlling various features of the vehicle 100. In one or more embodiments, a video display is provided to show images provided by the image sensor 148 or cameras located on the vehicle.

An engine 118 is mounted on the rear frame 104 and supplies power for all driven components of the motor grader 100. The engine 118, for example, is configured to drive a transmission (not shown), which is coupled to drive the rear wheels 108 at various selected speeds and either in forward or reverse modes. A hydrostatic front wheel assist transmission (not shown), in different embodiments, is selectively engaged to power the front wheels 106, in a manner known in the art.

Mounted to a front location of the front frame 102 is a drawbar or draft frame 120, having a forward end universally connected to the front frame 102 by a ball and socket arrangement 122 and having opposite right and left rear regions suspended from an elevated central section 124 of the front frame 102. Right and left lift linkage arrangements including right and left extensible and retractable hydraulic actuators 126 and 128, respectively, support the left and right regions of the drawbar 120. The right and left lift linkage arrangements 126 and 128 either raise or lower the drawbar 120. A side shift linkage arrangement is coupled between the elevated frame section 124 and a rear location of the drawbar 120 and includes an extensible and retractable side swing hydraulic actuator 130. A blade or mold board 132 is coupled to the front frame 102 and powered by a circle drive assembly 134. The blade 132 includes an edge 133 configured to cut, separate, or move material. As the vehicle 100 moves, the blade 132 collects surface material from the terrain and moves the collected surface material to a different location. While a blade 132 is described herein, other types of implements are contemplated.

The drawbar 120 is raised or lowered by the right and left lift linkage arrangements 126 and 128 which in turn raises or lowers the blade 132 with respect to the surface. The actuator 130 raises or lowers one end of the blade 132 to adjust the slope of the blade.

The circle drive assembly 134 includes a rotation sensor 136, which in different embodiments, includes one or more switches that detect movement, speed, or position of the blade 132 with respect to the vehicle front frame 102. The rotation sensor 136 is electrically coupled to a controller 138, which in one embodiment is located in the cab 110. In other embodiments, the controller 138 is located in the front frame 102, the rear frame 104, or within an engine compartment housing the engine 118. In still other embodiments, the controller 138 is a distributed controller having separate individual controllers distributed at different locations on the vehicle. In addition, while the controller is generally hardwired by electrical wiring or cabling to sensors and other related components, in other embodiments the controller includes a wireless transmitter and/or receiver to communicate with a controlled or sensing component or device which either provides information to the controller or transmits controller information to controlled devices.

A blade slope/position sensor 140 is configured to detect the slope and/or the position of the blade 132 and to provide slope and/or position information to the controller 138. In different embodiments, the blade slope/position sensor 140 is coupled to a support frame for the blade 132 of the hydraulic actuator 130 to provide the slope information. A mainfall sensor 142 is configured to detect the grading angle of the vehicle 100 with respect to gravity and to provide grading angle information to the controller 138. In one embodiment, the mainfall sensor 142 includes an inertial measurement unit (IMU) configured to determine a roll position and a pitch position with respect to gravity. The mainfall sensor 142 provides a signal including roll and pitch information of the straightline axis between wheel centers and consequently roll and pitch information of the vehicle 100. The roll and pitch information is used by an electronic control unit (ECU) 150 of FIG. 2 to adjust the position of the blade 132.

An antenna 144 is located at a top portion of the cab 110 and is configured to receive signals from different types of machine control systems including sonic systems, laser systems, and global positioning systems (GPS). While the antenna 144 is illustrated, other locations of the antenna 144 are included as is known by those skilled in the art. For instance, when the vehicle 100 is using a sonic system, a sonic tracker 146 is used detect reflected sound waves transmitted by the sonic system through with the sonic tracker 146. In a vehicle 100 using a laser system, a mast (not shown) located on the blade supports a laser tracker located at a distance above the blade 132. In one embodiment, the mast includes a length to support a laser tracker at a height similar to the height of a roof of the cab. A GPS system includes a GPS tracker located on a mast similar to that provided for the laser tracker system. Consequently, the present disclosure applies vehicle motor grader systems using both relatively "simple" 2D cross slope systems and to "high end" 3D grade control systems.

In additional embodiments, the grade control system includes devices, apparatus, or systems configured to determine the mainfall of the vehicle, as well as devices, apparatus, or systems configured to determine the slope and/or position of the blade. For instance, blade position is determined by one or more sensor. In one embodiment, an inertial measurement unit to determine blade position is used. Consequently, other systems to determine mainfall and blade slope/position are contemplated.

A forward ground image sensor 145 is fixedly mounted to the front frame 102 at a location generally unobstructed by any part of the vehicle 100. The forward ground image sensor 145 includes one or more of a transmitter, receiver, or a transceiver directed to the ground in front of and being approached by the vehicle 100. In different embodiments, the forward ground image sensor 145 includes one or more of a two dimensional camera, a three dimensional camera, a stereo camera, a monocular camera, a radar device, and a laser scanning device, an ultrasonic sensor, and a light detection and ranging (LIDAR) scanner. The forward ground image sensor 145 is configured to provide an image of the ground being approached, which is transmitted to the ECU 150 of FIG. 2. In different embodiments, the ground image sensor 145 is one of a grayscale sensor, a color sensor, or a combination thereof.

A rearward ground image sensor 147 is fixedly mounted to the rear frame 104 at a location generally unobstructed by any part of the vehicle 100. The rearward ground image sensor 147 includes one or more of a transmitter, receiver, or a transceiver directed to the ground behind and being left by the vehicle 100. In different embodiments, the rearward ground image sensor includes one or more of a two dimensional camera, a three dimensional camera, a stereo camera, a monocular camera, a radar device, and a laser scanning device, an ultrasonic sensor, and a light detection and ranging (LIDAR) scanner. The rearward ground image sensor 147 is configured to provide an image of the ground behind the vehicle, which is transmitted to the ECU 150 of FIG. 2. The images provided by the rearward ground image sensor 147 are used by the ECU 150 to determine one or more of a location of a windrow, a profile of a windrow, and a surface profile resulting from the grading operation. In one or more embodiments, the data determined by the ECU 150 based on the rearward ground image sensor is provided as a feedback signal that is used when adjusting the position of the implement. In different embodiments, the rearward ground image sensor 147 is one of a grayscale sensor, a color sensor, or a combination thereof.

An implement image sensor 149, in one embodiment, is fixedly mounted to the drawbar 120 and is oriented or directed toward the surface material being moved by the blade 132. The implement image sensor 149, in different embodiments, is a two dimensional camera or a three dimensional stereo camera located on the drawbar 120 at a position to image the surface material located near and on the blade 132. Locations of the material image sensor are contemplated to provide a relatively unobstructed view of the blade 132, surface material adjacent to the blade at either end of the blade, and surface material on the blade. The implement image sensor 149 provides an image or images of the surface material which are transmitted to the ECU 150 of FIG. 2. In different embodiments, the implement image sensor 149 is one of a grayscale sensor, a color sensor, or a combination thereof.

Figure 2:
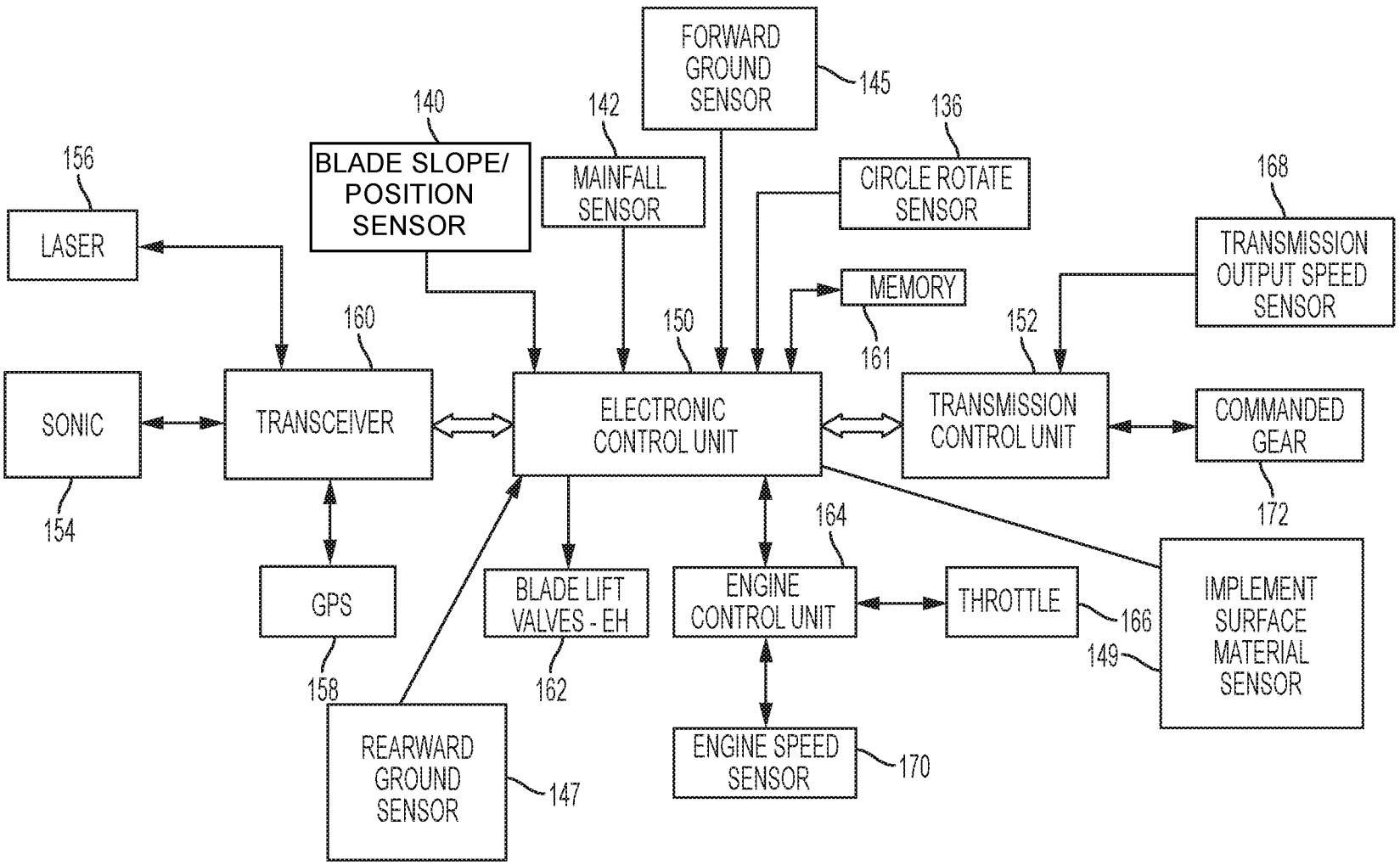
FIG. 2 is a simplified schematic diagram of a vehicle and a vehicle grade control system of the present disclosure.

FIG. 2 is a simplified schematic diagram of the vehicle 100 and a vehicle grade control system, including control circuitry, embodying the invention. In this embodiment, the controller 138 is configured as the ECU 150 operatively connected to a transmission control unit 152. The ECU 150 is located in the cab 110 of vehicle 100 and the transmission control unit 152 is located at the transmission of the vehicle 100. The ECU 150 receives slope, angle, and/or elevation signals generated by one or more types of machine control systems including a sonic system 154, a laser system 156, and a GPS system 158. Other machine control systems are contemplated. These signals are collectively identified as contour signals. Each of the machine control systems 154, 156, and 158 communicates with the ECU 150 through a transceiver 160 which is operatively connected to the appropriate type of antenna as is understood by those skilled in the art.

The ECU 150, in different embodiments, includes a computer, computer system, or other programmable devices. In other embodiments, the ECU 150 can include one or more processors (e.g. microprocessors), and an associated memory 161, which can be internal to the processor or external to the processor. The memory 161 can include random access memory (RAM) devices comprising the memory storage of the ECU 150, as well as any other types of memory, e.g., cache memories, non-volatile or backup memories, programmable memories, or flash memories, and read-only memories. In addition, the memory can include a memory storage physically located elsewhere from the processing devices and can include any cache memory in a processing device, as well as any storage capacity used as a virtual memory, e.g., as stored on a mass storage device or another computer coupled to ECU 150. The mass storage device can include a cache or other dataspace which can include databases. Memory storage, in other embodiments, is located in the "cloud", where the memory is located at a distant location which provides the stored information wirelessly to the ECU 150. When referring to the ECU 150 and the memory 161 in this disclosure other types of controllers and other types of memory are contemplated.

The ECU 150 executes or otherwise relies upon computer software applications, components, programs, objects, modules, or data structures, etc. Software routines resident in the included memory of the ECU 150 or other memory are executed in response to the signals received. The computer software applications, in other embodiments, are located in the cloud. The executed software includes one or more specific applications, components, programs, objects, modules or sequences of instructions typically referred to as "program code". The program code includes one or more instructions located in memory and other storage devices which execute the instructions which are resident in memory, which are responsive to other instructions generated by the system, or which are provided a user interface operated by the user. The ECU 150 is configured to execute the stored program instructions.

The ECU 150 is also operatively connected to a blade lift valves assembly 162 (see FIG. 2) which is in turn operatively connected to the right and left lift linkage arrangements 126 and 128 and the actuator 130. The blade lift valves assembly 162, in one embodiment, is an electrohydraulic (EH) assembly which is configured to raise or lower the blade 132 with respect to the surface or ground and to one end of the blade to adjust the slope of the blade. In different embodiments, the valve assembly 162 is a distributed assembly having different valves to control different positional features of the blade. For instance, one or more valves adjust one or both of the linkage arrangements 126 and 128 in response to commands generated by and transmitted to the valves and generated by the ECU 150. Another one or more valves, in different embodiments, adjusts the actuator 130 in response to commands transmitted to the valves and generated by the ECU 150. The ECU 150 responds to grade status information, provided by the sonic system 154, the laser system 156, and the GPS 158, and adjusts the location of the blade 132 through control of the blade lift valves assembly 162. The location of the blade is adjusted based on the current position of the blade with respect to the vehicle, speed of blade if being manipulated, and the direction of the blade.

To achieve better productivity and to reduce operator error, the ECU 150 is coupled to the transmission control unit 152 to control the amount of power applied to the wheels of the vehicle 100. The ECU 150 is further operatively connected to an engine control unit 164 which is, in part, configured to control the engine speed of the engine 116. A throttle 166 is operatively connected to the engine control unit 164. In one embodiment, the throttle 166 is a manually operated throttle located in the cab 110 which is adjusted by the operator of vehicle 100. In another embodiment, the throttle 166 is additionally a machine controlled throttle which is automatically controlled by the ECU 150 in response to grade information and vehicle speed information.

The ECU 150 provides engine control instructions to the engine control unit 164 and transmission control instructions to the transmission control unit 152 to adjust the speed of the vehicle in response to grade information provided by one of the machine control systems including the sonic system 154, the laser system 156, and the GPS system 158. In other embodiments, other machine control systems are used. Vehicle direction information is determined by the ECU 150 in response to direction information provided by the steering device 114.

Vehicle speed information is provided to the ECU 150, in part, by the transmission control unit 152 which is operatively connected to a transmission output speed sensor 168. The transmission output speed sensor 168 provides a sensed speed of an output shaft of the transmission, as is known by those skilled in the art. Additional transmission speed sensors are used in other embodiments including an input transmission speed sensor which provides speed information of the transmission input shaft.

Additional vehicle speed information is provided to the ECU 150 by the engine control unit 164. The engine control unit 164 is operatively connected to an engine speed sensor 170 which provides engine speed information to the engine control unit 164.

A current vehicle speed is determined at the ECU 150 using speed information provided by one of or both of the transmission control unit 152 and the engine control unit 164. The speed of the vehicle 100 is increased by speed control commands provided by the ECU 150 when the grade control system is on target to ensure maximum productivity.

The forward ground sensor 145, the rearward ground sensor 147, and the implement image sensor 149 are each operatively connected to the ECU 150. Each of the sensors 145, 147, and 149 transmits one or more images of the surface material in front of the vehicle 100, the surface material in the rear of the vehicle 100, and the surface material located on or adjacent to the blade 132.

Figure 3A:
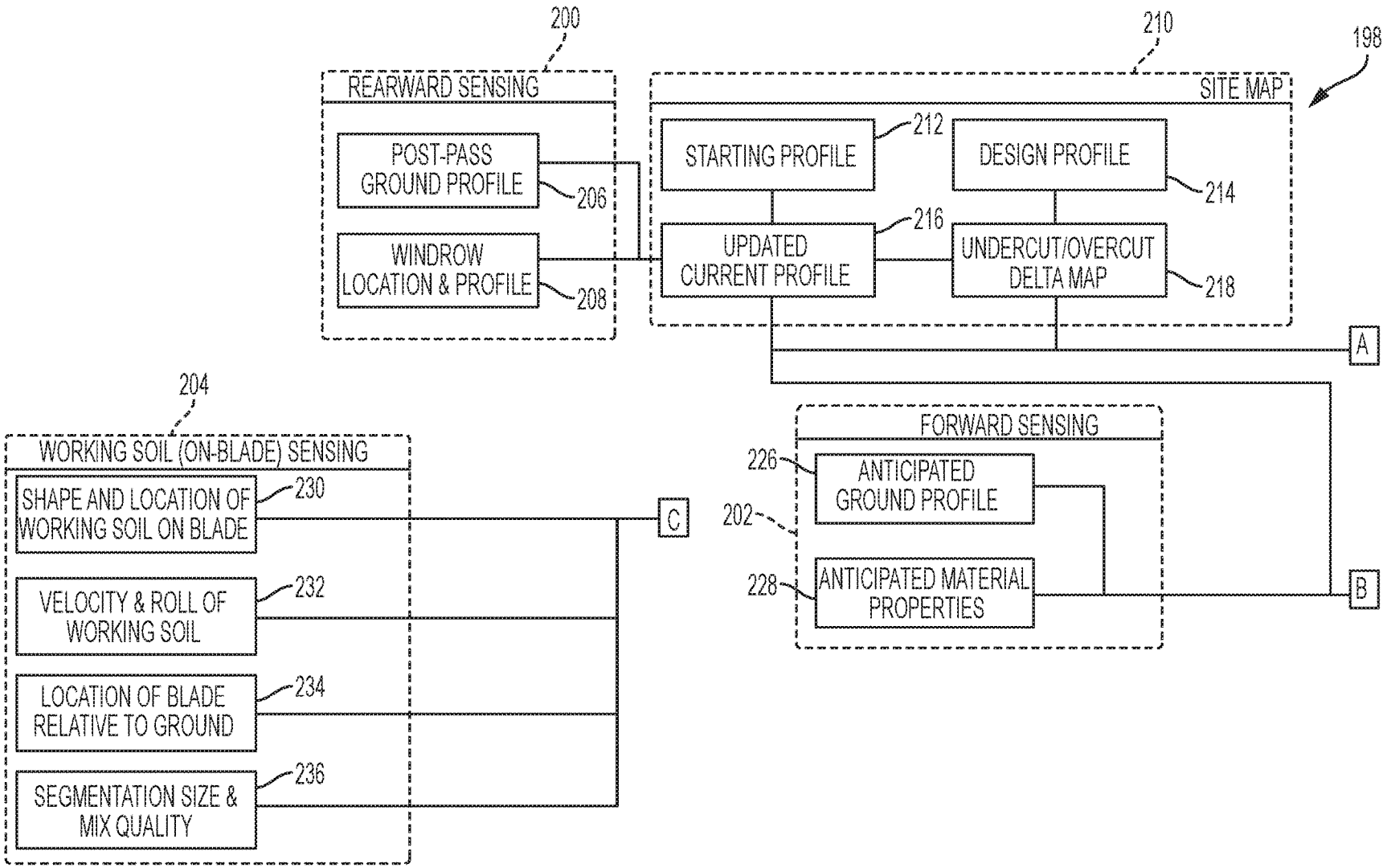
FIGS. 3A and 3B are a control system block diagram of one embodiment of the present vehicle system.
Figure 3B:
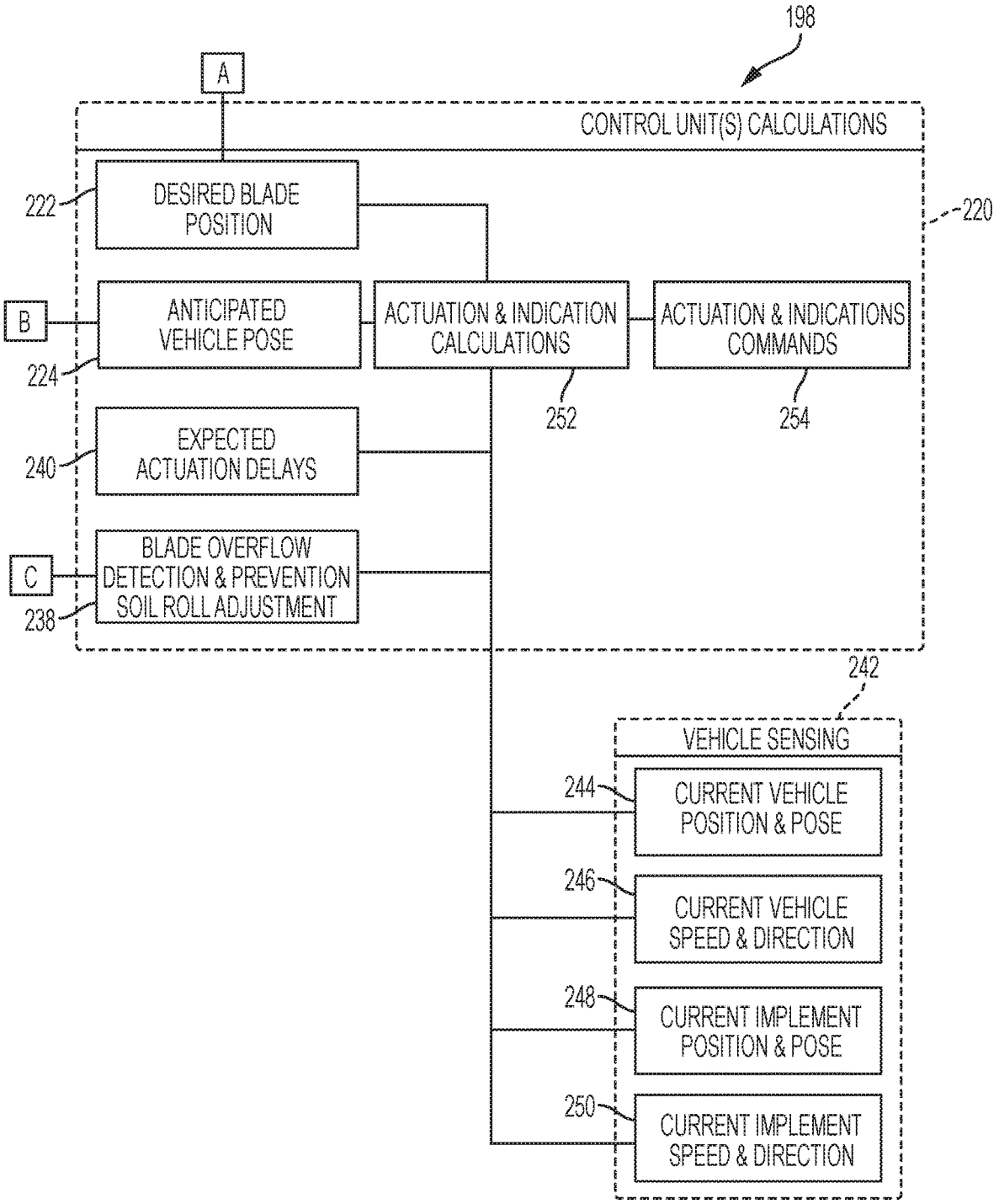

FIGS. 3A and 3B illustrate a control system block diagram 198 of one embodiment of the present vehicle system configured to provide forward sensing, rearward sensing, and implement sensing for adjusting the position of the implement 132 during a grading operation. Each of the blocks of the diagram illustrate technical features provided by each of the sensors 145, 147 and 149 transmitting image information to the electronic control unit 150. A rearward sensing block 200 includes features performed by the ECU 150 based on images received from the rearward ground image sensor 147. A forward sensing block 202 includes features performed by ECU 150 based on images received from the forward ground image sensor 145. A working soil (on-blade) sensing block 204 includes features performed by ECU 150 based on images performed by the implement image sensor 149.

The rearward sensing block 200 illustrates one embodiment of software module stored in the memory 161 operatively connected to the ECU 150. As described above other configurations of program code are contemplated when referring to a module. The rearward sensor 147 transmits images to the ECU 150 which determines a post-pass ground profile 206 and a windrow location and profile 208. The images provided by the sensors result from an image scan of the surface located in front of or behind the vehicle 100, and near or on the blade. Image content is determined by one or more image classification algorithms located in the ECU 150 or the memory 161. In one or more embodiments, image classification algorithms, such as edge detection and object detection algorithms, provide up to date surface or terrain information used to update a site map represented by a site map block 210. Image classification algorithms including an identification of contrast and texture information of the surface material are also contemplated.

In one embodiment, the site map of block 210 is stored in the memory 161. Other memory locations are contemplated. The site map includes a starting profile map 212, a design profile (or target) map 214, an updated current profile map 216, and an undercut/overcut delta map 218. The starting profile map includes terrain information provided by one or more sensing devices which are separate from the vehicle 100. In one embodiment, the starting profile map is provided by a drone having a sensing device and related processing system to generate the starting profile map. The starting profile map 212 includes slope and/or height information and is transmitted to the vehicle and stored in the memory 161.

The design profile map 214 includes a predetermined map of a desired grade target, a final terrain profile, including slope and/or height information of a final grade. As the vehicle 100 moves along the surface, the updated current profile map 216 is generated by the ECU 150 using the post-pass ground profile data 206 and the windrow location and profile data 208. The updated current profile data is compared to the design profile data by an undercut/overcut software module to generate the undercut/overcut delta map 218. The delta map 218 includes data configured to adjust the blade position and data indicating a location of where the current surface material must be undercut or must be overcut (added to) to achieve the design profile.

The updated current profile data and undercut/overcut delta map data is stored in the memory 161 and is accessed by the ECU 150, which is configured to determine or to calculate at an arithmetic logic unit or calculating device 220 a desired blade position at desired blade position block 222. The updated current profile data and undercut/overcut delta map data are also accessed by the ECU 150 to determine an anticipated vehicle pose at an anticipated vehicle pose block 224, which is a vehicle position with respect to gravity, which in turn, determines in part the position of the blade with respect to the current surface being configured to the final design profile 214. In different embodiments, the vehicle pose data includes roll, pitch, and/or yaw positional data. In this disclosure "delta" means a difference of the design profile 214 with the updated current profile 216.

The forward sensing block 202 illustrates one embodiment of software module stored in the memory 161 operatively connected to the ECU 150. The forward sensor 145 transmits images to the ECU 150 which determines an anticipated ground profile 226 and a windrow location and profile 228. The image data provided by the sensor 145 results from an image scan of the surface located in front the vehicle 100, the content of which is determined by one or more image classification algorithms located in the ECU 150 or the memory 161. In one or more embodiments, image classification algorithms, such as edge detection and object detection algorithms, provide anticipated ground profile data and anticipated material property data.

The material property data of the surface materials includes but is not limited to data representing the types of surface materials, the conditions of the surface materials, and the characteristics of the surface material being captured by the blade. Types of surface materials include, but are not limited to, soil, rock, pebble, stone, minerals, organic matter, clay and vegetation. Conditions of surface materials include, but are not limited to, soft, hard, wet, dry, and segmentation. Characteristics of surface material include, but are not limited to an amount, location, a shape, and a velocity of the material as it is moved by the blade. The image classification algorithms are configured to determine one or more of the types, conditions, and characteristics. The anticipated ground profile data and the anticipated material property data is used by the anticipated vehicle pose module to determine the anticipated vehicle pose at block 224.

A working soil sensing block 204 is configured to identify one or more of the material property data (identified as soil in FIG. 3B) of the surface materials including but not limited to data representing the types of surface materials, the conditions of the surface materials, and the characteristics of the surface material being captured by the blade. For instance at block 230, the shape and location of the working soil on the blade is determined. At block 232, the velocity and material roll of the working soil on the blade 132 is determined. Material roll includes an identification of how the material rolls on the blade as well as how the material rolls off the blade. In different embodiments material roll includes one or more images of the proximity of surface material to the top of implement and how far does the material extends from the implement when leaving one or both ends of the blade. The velocity is determined based on the speed at which the material moves along the blade and off the blade during a grading operation. At block 234, the location of the blade relative to the ground is determine. At block 236, the segmentation size and mix quality is determined.

Each of the blocks 230, 232, 234, and 236 provides data identifying the working soil near or on the blade which is transmitted to the calculating device 220 at a blade overflow detection and prevention block 238. The calculation device 220, using this data, provides a material or soil roll adjustment value.

The calculation device 220 accesses the data provided by the forward sensing block 202, the working soil sensing block 204, the site map block 210, and an expected actuations delays block 240. The expected actuation delays block 240, in one or more embodiments, includes data identifying the actuation delay of the blade resulting from the arrangement of the system hardware and the system software. For instance, the length of actuating arms and hydraulic system that affects actuation times, is an identifiable value and is stored in the memory 161 as a data, such as a in lookup table. Other actuation delays are contemplated and understood by those skilled in the art.

Additional vehicle data is provided by a vehicle sensing block 242 including current vehicle position and pose data provided by a current vehicle position and pose block 244, current vehicle speed and direction data provided by a current vehicle speed and direction block 246, current implement position and pose data provided by a current implement position and pose block 248, and current implement speed and direction data provided by a current implement speed and direction data block 250.

The data provided by the blocks 244, 246, 248, and 250 of the vehicle sensing block 242 represents the sensed data of the described devices of the vehicle 100 described with respect to the system diagram of FIG. 2. For instance, the transceiver 160 transmits vehicle position from the GPS 158

The calculating device 220 accesses the data provided by the vehicle sensing block 242 and the data provided by blocks 222, 224, 238, and 240 at an actuation and indication calculations module 252. The module 252 is configured to generate one or more actuation and indications commands at an actuation and indications commands module 254. Once determined, the actuation and indications commands are transmitted to one or more of the devices used to adjust the position of the blade 132. In one or more embodiments, the commands are transmitted to actuators employed by the right and left lift linkage arrangements 126 and 128 and the actuator 130 which raises or lowers one end of the blade 132 to adjust the slope of the blade, as well as the circle drive assembly 134.

As the vehicle 100 moves along the terrain, the forward sensor 145 generates forward looking image data, the rearward sensor 147 generates rearward looking sensor data, and the implement image sensor 149 generates material image data of the material on the blade and adjacent to the blade, each of which is transmitted to the ECU 150. The ECU 150 is configured to process the received image data to determine an optimized position of the blade 132.

The position of the blade is adjusted to grade the surface toward the grade target. In addition, the position of the blade, in one or more embodiments, is also adjusted to optimize the displacement of the material as it is collected or moved by the blade. The ECU 150 positions the blade to achieve the grade target, while also improving how the material rolls, flows, or moves off the blade.

While exemplary embodiments incorporating the principles of the present disclosure have been described hereinabove, the present disclosure is not limited to the described embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A method of grading a surface with a work vehicle moving along the surface, the surface having a ground profile and formed of a surface material, the vehicle having a frame supported by a ground engaging traction device and an implement adjustably coupled to the frame, the method comprising:

receiving a grade target identifying a desired grade for the surface being graded with the implement;

collecting surface material on the implement;

identifying a material property of the collected surface material with an implement image sensor directed toward the implement, the identified material property based on an image provided by the implement image sensor of the surface material near or on the implement;

identifying a position of the implement with respect to the surface;

adjusting the position of the implement based on the identified position and the identified material property;

grading the surface to the grade target with the adjusted position of the implement.

2. The method of claim 1 wherein the identifying the material property of the collected surface material includes identifying one of a type of the surface material, a condition of the surface material, and a characteristic of the surface material.

3. The method of claim 1 wherein the identifying a material property of the collected surface material includes identifying a location of the collected surface material on the implement.

4. The method of claim 1 wherein the identifying a material property of the collected surface material includes identifying a shape of the collected surface material on the implement.

5. The method of claim 1 wherein the identifying a material property of the collected surface material includes identifying a velocity of the collected surface material on the implement.

6. The method of claim 1 wherein the identifying a material property of the collected surface material includes identifying a material roll of the collected surface material on the implement.

7. The method of claim 1 further comprising identifying the surface being approached with a forward ground sensor.

8. The method of claim 7 wherein the identified material property includes one or more of a type of surface material, a condition of the surface material, and a characteristic of the surface material.

9. The method of claim 1 wherein the implement is a blade and the identifying a material property includes identifying a velocity of the surface material as the surface material moves along the blade or off the blade during grading of the surface.

10. The method of claim 1 wherein the implement is a blade and the identifying the material property includes identifying a material roll of the surface material as the surface material rolls on the blade or rolls off the blade during grading of the surface.

11. The method of claim 1 wherein the work vehicle includes a drawbar coupled to the frame and the implement image sensor is mounted to the drawbar.

12. The method of claim 11 wherein the implement image sensor is one of a two dimensional camera or a three dimensional camera.

13. A method of grading a surface with a work vehicle moving along the surface, the surface having a ground profile and formed of a surface material, the vehicle having a frame supported by a ground engaging traction device and an implement adjustably coupled to the frame, the method comprising:

receiving a grade target identifying a desired grade for the surface being graded with the implement;

collecting surface material on the implement;

identifying a material property of the collected surface material;

identifying a position of the implement with respect to the surface;

adjusting the position of the implement based on the identified position and the identified material property;

grading the surface to the grade target with the adjusted position of the implement;

identifying a front ground profile in front of the work vehicle, wherein the adjusting the position of the implement is based on the identified front ground profile; and identifying a rear ground profile at the rear of the work vehicle, wherein the adjusting the position of the implement is based on the identified rear ground profile.

14. The method of claim 13 further comprising generating a map of the surface including an updated surface profile based on the grading of the surface.

15. The method of claim 14 wherein the generating a map includes generating an undercut/overcut delta map based on a comparison of the grade target and the updated surface profile.

16. The method of claim 13 wherein the implement is a blade and the identifying a material property includes one of identifying a velocity of the surface material at the blade or identifying a material roll of the surface material as the surface material rolls on the blade or off the blade during grading of the surface.

17. A method of grading a surface with a work vehicle moving along the surface, the surface having a ground profile and formed of a surface material, the vehicle having a frame and an implement being adjustably coupled to the frame, the method comprising:

identifying a front surface profile in front of the work vehicle;

identifying a material property of a collected surface material located on the implement;

identifying a rear surface profile at the rear of the work vehicle;

adjusting a position of the implement based on the identified front surface profile, the identified material property, and the identified rear surface profile; and grading the surface to a grade target with the adjusted position of the implement.

18. The method of claim 17 wherein the identifying the material property of the collected surface material includes identifying one or more of a type of surface material, a condition of the surface material, and a characteristic of the surface material.

19. The method of claim 18 further comprising:

identifying a current profile of the surface being graded;

comparing the identified current profile to the grade target; and generating an undercut/overcut delta map based on the comparing step.

20. The method of claim 19 wherein the adjusting the position of the implement further comprises adjusting the position of the implement based on the generated undercut/overcut delta map.

* * * * *